United States Patent [19]

Ghidelli

[11] 4,062,175

[45] Dec. 13, 1977

[54] APPARATUS FOR PRODUCING FLAKED YARNS

[76] Inventor: Massimo Ghidelli, Vigano Brianza (Como), Italy

[21] Appl. No.: 732,731

[22] Filed: Oct. 14, 1976

Related U.S. Application Data

[63] Continuation of Ser. No. 485,312, July 2, 1974, abandoned, which is a continuation-in-part of Ser. No. 270,197, July 10, 1972, abandoned.

[30] Foreign Application Priority Data

July 28, 1971 Italy ..... 7788/71

[51] Int. Cl.[2] ..... D01H 5/28

[52] U.S. Cl. ..... 57/36; 19/237

[58] Field of Search ..... 19/237, 238, 258; 57/38.3, 39, 36, 91

[56] References Cited

U.S. PATENT DOCUMENTS

| | | | |
|---|---|---|---|
| 32,166 | 4/1861 | Stoddard | 57/38.3 |
| 3,394,538 | 7/1968 | Neff | 57/38.3 |
| 3,487,619 | 1/1970 | Field, Jr. | 57/36 X |

FOREIGN PATENT DOCUMENTS

| | | | |
|---|---|---|---|
| 1,033,490 | 4/1953 | France | 19/258 |

*Primary Examiner*—Dorsey Newton

[57] ABSTRACT

An apparatus for producing flaked or nubbed yarns wherein the method is carried out by altering the draft effect on the sliver of the yarn through providing, in the rubber roller of a draft apparatus of a conventional textile machine, grooves or depressions so that a flaked yarn section is obtained with a stronger resistance to traction due to a thicker accumulation of textile material.

1 Claim, 2 Drawing Figures

APPARATUS FOR PRODUCING FLAKED YARNS

This is a continuation, of application Ser. No. 485,312 filed July 2, 1974, now abandoned, which is a continuation-in-part application of Ser. No. 270,197 filed July 10, 1972 now abandoned.

The present invention relates to an apparatus for producing "flaked", "nubbed" or other irregular yarns, and particularly to a spindle frame therefore.

DESCRIPTION OF THE PRIOR ART

It is known that flaked yarns may be produced by altering, through suitable mechanical, electrical or electronic arrangements, the speed of a fluted draft roller which is formed of metal, and which operatively cooperates with a rubber roller. These rollers are components of a drafting apparatus or drafting zone of an installation, and are driven so as to rotate at very high linear or peripheral speeds of up to 17 meters/sec, in order to obtain a draft of up to 100 meters or more. The prior art method requires the provision of a complex and expensive gearing transmission, consequentially resulting in much high processing costs. Moreover, the "flaked" sections of the yarn usually are found to be the weakened sections of the yarn since, after drafting of the yarn, breakages usually take place only in the flaked sections.

SUMMARY OF THE INVENTION

Accordingly, it is an object of the present invention to provide an apparatus adapted to be readily utilized in conjunction with any textile machine in this field of technology, adapted to effect simple or composite drafting, such as spindle frame-intersecting, or combing machines and the like, wherein there is generated a uniform degree of drafting tension.

According to the present invention, the apparatus for producing flaked yarn in a textile machine includes the use of a drafting device for condensed sliver by means of a pair of mutually cooperating holding rollers and a pair of cooperating drafting rollers. One of the drafting rollers is of rubber or has a peripheral rubber covering, and the other is a fluted steel roller. The rollers carry out the step of altering the drafting effect of the condensed sliver of the yarn by means of annular or circumferentially extending grooves or depressions which are formed about the peripheral or cylindrical surface of the rubber or rubber-faced roller. The number, widths and pattern of the depressions, or grooves are defined so that a consequential altering or change of the draft is cyclically produced in dependence upon the roller rotation, thereby providing a large variety of flaked yarns without any need for modifying the transmission gearing of the textile machines.

In a preferred embodiment of the invention the grooves which extend about the annular surface of the cylindrical rubber roller of the drafting roller pair are formed of a plurality of discontinuous parallel grooves which extend along only a portion of the periphery, and are then continued by other laterally offset parallel grooves in order to provide a discontinuous groove pattern along the roller periphery, and in which the grooves are smaller or narrower than the sliver. The grooves are not necessarily uniform in their disposition about the annular surface, but may be irregularly or randomly spaced.

Experiments have proved that the flaked sections in the yarn, corresponding to, for example, the grooves in the annular surface of the rubber roller, and which consequently provide reduced draft regions in the yarn, are effectively more resistant to breaking as a result of a thicker material accumulation produced by the present method. It becomes readily apparent that the sole means required for obtaining the flaking of the yarn is the substitution of the inventive grooved or recessed rubber roller structure for a known rubber roller which possesses an even or smooth annular profile for producing unflaked yarn.

Other objects and advantageous features of the invention will become more readily apparent from the following description and drawing.

BRIEF DESCRIPTION OF THE DRAWING

Reference may now be had to a detailed description of the invention, taken in conjunction with the accompanying drawing; in which.

DESCRIPTION OF A PREFERRED EMBODIMENT

Figure 1:
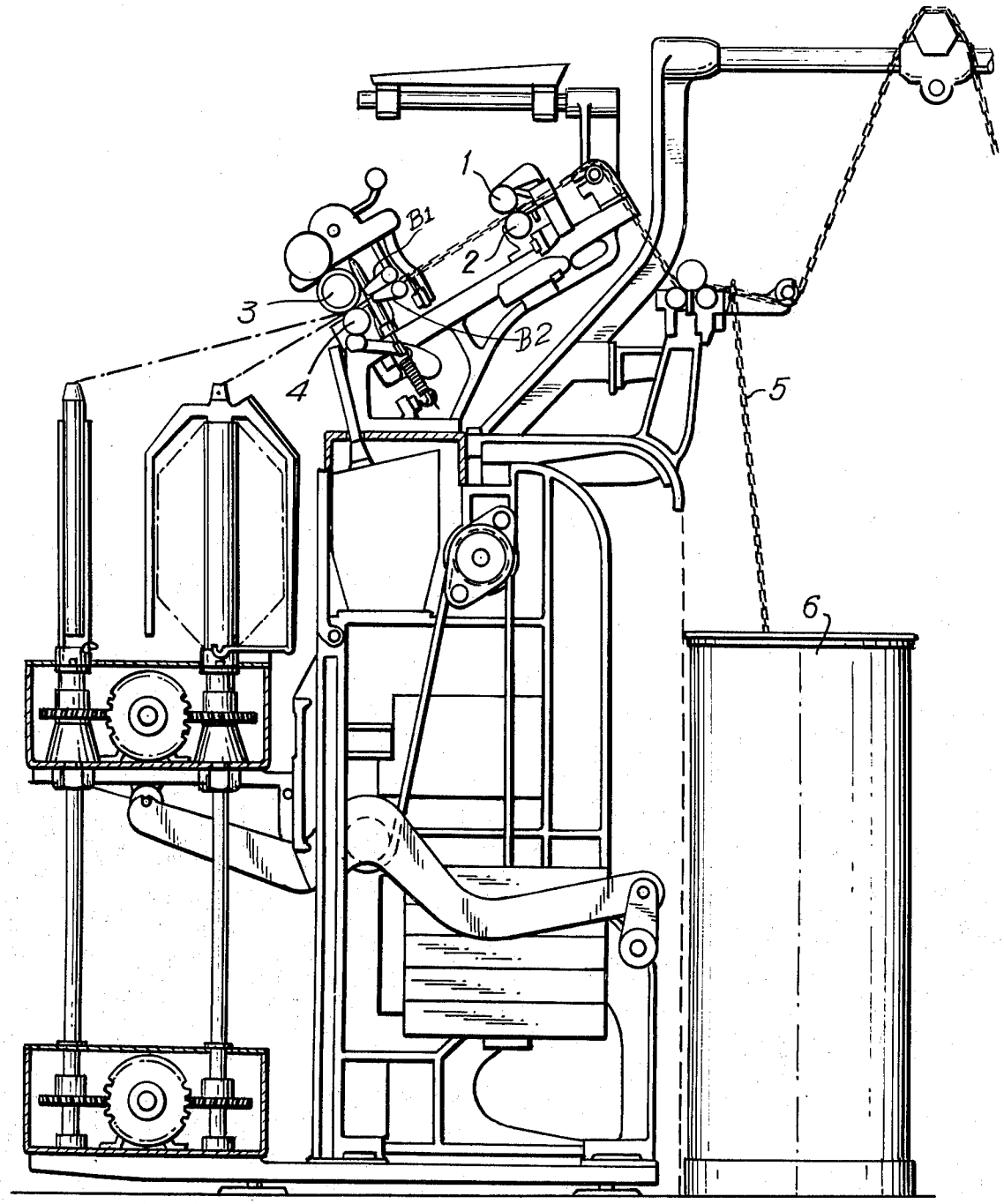
FIG. 1 is an elevational side view of a textile spindle frame incorporating a drafting apparatus pursuant to the present invention.
Figure 2:
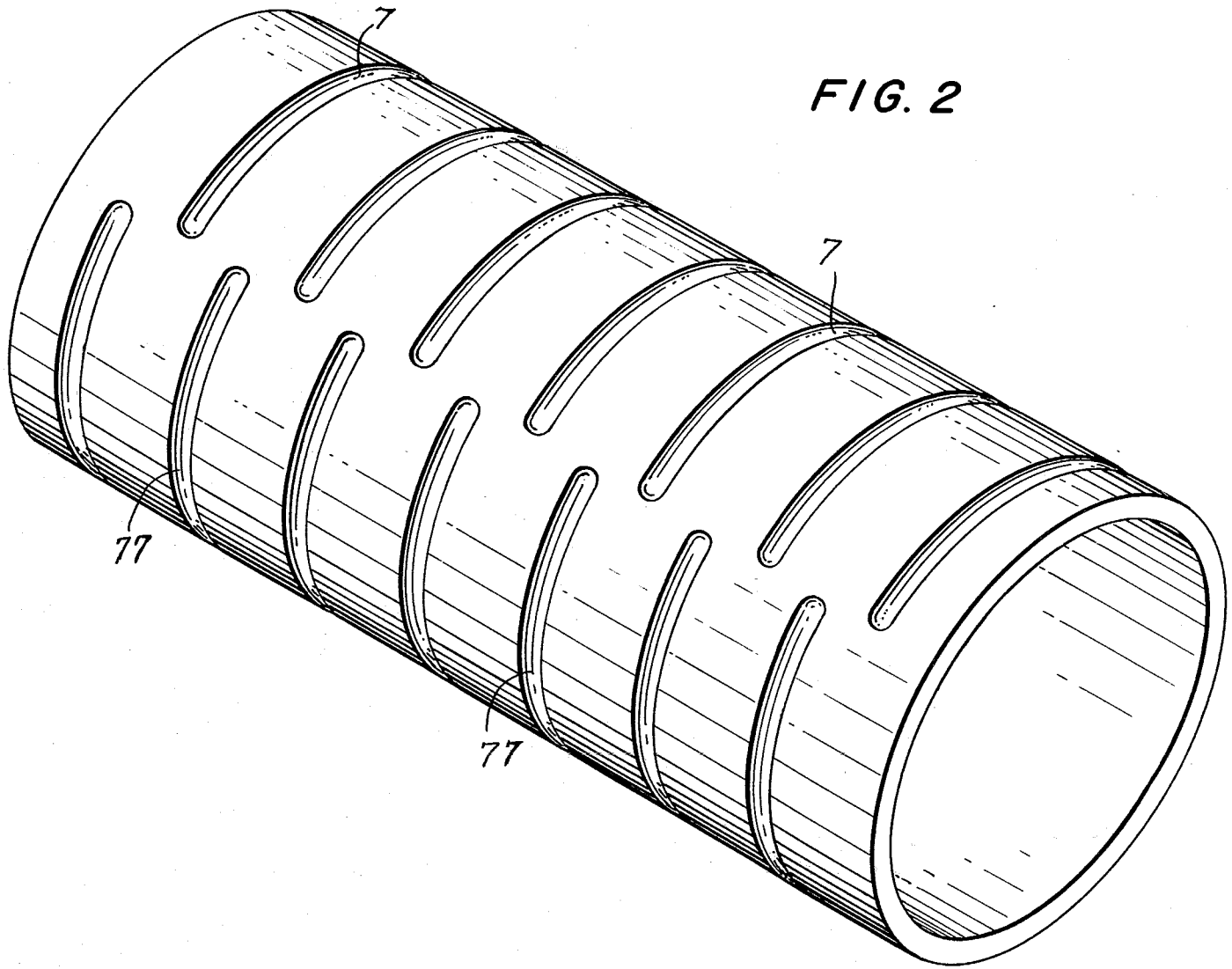
FIG. 2 is an enlarged perspective view of a grooved rubber drafting roller employed in the drafting apparatus of FIG. 1.

In FIG. 1 of the drawing, 1 and 2 represent the back or holding rollers. A pair of drafting rollers 3 and 4 include, respectively, a pressing roller 3 which is made of rubber or which is rubber faced, and a fluted drawing roller 4 which is made of steel. The condensed sliver 5 which is to be worked to form a flaked yarn is fed from the receptacle 6 and undergoes a very high degree of draft as a result of the cooperation between the respective pairs of rollers 1, 2, and 3, 4 which are interconnected by driven endless braking belts B1 and B2. Generally, in operation, only the roller 2 and 4 are positively driven. In accordance with the invention, the annular surface or cylindrical facing of the rubber or rubber faced pressing roller 3 does not have a completely smooth cylindrical surface, but is formed with a number of peripherally extending grooves 7 so that, during the rotation of the pressing rubber roller 3 and of the drawing roller 4, an irregular draft is formed in the condensed sliver through the interaction of the rollers and grooves, and whereby this then results in forming an irregularly flaked yarn.

In effect, the grooves 7 on the roller circumference comprise a plurality of annular discontinuous and parallel spaced grooves 7 which extend along only a portion of the annular circumference of the roller 3. The roller then has another group of laterally offset parallel grooves 77 continuing for another length of the roller circumference. This may be repeated for the remaining circumference of the roller so as to provide a pattern of discontinuous annular laterally offset groups of parallel grooves formed along the cylindrical surface of rubber roller 3. In order to provide the flaked yarn, the grooves 7 and 77 are smaller or narrower than the width of the sliver.

Furthermore, in accordance with the invention, the foregoing concept may be applied to one of the pair of holding rollers 1 or 2, in effect forming grooves of the type mentioned in one of the rollers, and in that instance the extent of flaking operation can be greatly enhanced.

It is to be understood that the invention covers a processing apparatus for producing flaked yarns as well the novel roller structure for obtaining the flaking yarn configuration; and machines containing such rollers.

While there has been shown what is considered to be the preferred embodiment of the invention, it will be obvious that modifications may be made which come within the scope of the disclosure of the specification.

What is claimed is:

1. A device for forming a flaked yarn, comprising: a drawing device for a sliver, said drawing device comprising a pair of rotatable holding rollers including a first and a second roller in mutually cooperative pressure contact, and a pair of delivery drafting rollers including a third and a fourth roller in mutually cooperative pressure contact, said pair of drafting rollers being spaced from said pair of holding rollers so as to form a drafting zone therebetween, said third roller having a fluted peripheral steel surface and said fourth roller having a peripheral rubber surface, a plurality of spaced and mutually staggered grooves being formed in and extending around the annular cylindrical surface of said rubber surface, the width of each groove being smaller than the thickness of the sliver compressed between said rollers, said spaced grooves extending for only a portion of the circumference of said roller, and further laterally offset spaced grooves extending along successive portions of said roller circumference so as to form a pattern of discontinuous groups of grooves extending around the cylindrical annular surface of said rubber-surface roller; and twising means located downstream of the said drawing rollers receiving the drafted sliver therefrom whereby, after the drawing operation and responsive to the passage of the sliver between said drafting rollers and to the differential drawing effect caused by the said grooves, said twisting means form said drafted sliver into a flaked yarn.

* * * * *